US009345642B2

(12) United States Patent
Heath et al.

(10) Patent No.: US 9,345,642 B2
(45) Date of Patent: May 24, 2016

(54) VIAL ADAPTER FOR A NEEDLE-FREE SYRINGE

(71) Applicant: PharmaJet Inc., Golden, CO (US)

(72) Inventors: Michael Heath, Golden, CO (US); Chris Cappello, Golden, CO (US)

(73) Assignee: PharmaJet, Inc., Golden, CO (US)

( * ) Notice: Subject to any disclaimer, the term of this patent is extended or adjusted under 35 U.S.C. 154(b) by 225 days.

(21) Appl. No.: 14/196,434

(22) Filed: Mar. 4, 2014

(65) Prior Publication Data

US 2014/0261860 A1 Sep. 18, 2014

Related U.S. Application Data

(60) Provisional application No. 61/782,500, filed on Mar. 14, 2013.

(51) Int. Cl.
*A61J 1/20* (2006.01)

(52) U.S. Cl.
CPC ..... *A61J 1/2096* (2013.01); *A61J 1/2037* (2015.05); *A61J 1/2055* (2015.05)

(58) Field of Classification Search
CPC ..... A61J 1/20; A61J 1/2037; A61J 1/2048; A61J 1/2055; A61J 1/2096
USPC ..... 141/2, 18, 21, 25, 27, 329
See application file for complete search history.

(56) References Cited

U.S. PATENT DOCUMENTS 5,423,791 A * 6/1995 Bartlett ..... A61J 1/2096 604/403
5,833,213 A * 11/1998 Ryan ..... A61J 1/2096 251/149.1
6,558,365 B2 * 5/2003 Zinger ..... A61J 1/2089 141/329
6,681,946 B1 * 1/2004 Jansen ..... A61J 1/1406 141/329
6,699,229 B2 * 3/2004 Zinger ..... A61J 1/2089 141/329
6,945,417 B2 * 9/2005 Jansen ..... A61J 1/1406 141/329
7,615,041 B2 * 11/2009 Sullivan ..... A61J 1/2096 604/403
7,743,799 B2 * 6/2010 Mosler ..... A61J 1/2096 141/302
8,684,992 B2 * 4/2014 Sullivan ..... A61J 1/2096 604/403
2002/0087141 A1 * 7/2002 Zinger ..... A61J 1/2089 604/414
2003/0109846 A1 6/2003 Zinger
2003/0153895 A1 8/2003 Leinsing (Continued)

OTHER PUBLICATIONS

International Search Report and Written Opinion dated Apr. 28, 2014 for International Application No. PCT/US2014/020335.

*Primary Examiner* — Nicolas A Arnett
(74) *Attorney, Agent, or Firm* — Swanson & Bratschun, L.L.C.

(57) ABSTRACT

A vial adapter for a needle-free injection syringe and methods of filling a needle-free syringe from a vial of injectable fluid. One vial adapter embodiment includes a housing and a compliant valve. The housing includes a central divider located between a vial opening and a needle-free syringe opening. The housing also includes a hollow center post extending from the central divider toward the needle-free syringe opening and a hollow filling needle extending from the central divider toward the vial opening. Together, the filling needle and center post provide for fluid communication between the vial opening and the needle-free syringe opening. The compliant valve includes a surface forming a fluid tight seal with the central divider and an inner passageway. In addition, a syringe sealing surface provides for a fluid tight seal with a needle-free syringe placed into contact with the compliant valve. The compliant valve includes an opening in the syringe sealing surface which is biased closed when no needle-free syringe is engaged with the vial adapter and which is opened when a needle-free syringe is fully engaged with the opening.

17 Claims, 5 Drawing Sheets

(56) References Cited

U.S. PATENT DOCUMENTS

| | | | | |
|---|---|---|---|---|
| 2004/0129343 | A1* | 7/2004 | Jansen | A61J 1/1406 141/329 |
| 2006/0025747 | A1* | 2/2006 | Sullivan | A61J 1/2096 604/411 |
| 2007/0106244 | A1* | 5/2007 | Mosler | A61J 1/2096 604/411 |
| 2008/0249479 | A1 | 10/2008 | Zinger | |
| 2010/0022985 | A1* | 1/2010 | Sullivan | A61J 1/2096 604/407 |
| 2011/0015566 | A1 | 1/2011 | Pan | |
| 2012/0220978 | A1 | 8/2012 | Lev | |
| 2013/0035634 | A1 | 2/2013 | Cappello | |
| 2014/0261877 | A1* | 9/2014 | Ivosevic | A61J 1/2096 141/27 |

* cited by examiner

VIAL ADAPTER FOR A NEEDLE-FREE SYRINGE

TECHNICAL FIELD

The embodiments disclosed herein relate generally to a vial adapter for a needle-free injection syringe and methods of filling a needle-free syringe from a vial of injectable fluid.

BACKGROUND

Vaccines, injectable medications and other injectable therapeutic fluids are often delivered to a physician, nurse or other medical technician in glass or plastic vial. The opening of a vial is typically sealed with a rubber or silicone septum. The septum and opening end of the vial are then sealed with metal foil or another removable cap. This type of vial configuration was developed for use with typical hypodermic needle syringes. Therefore, the technician administering the injection pierces the rubber septum with the hypodermic needle prior to filling the syringe. Piercing the septum places the lumen of the needle into fluid communication with the injectable content of the vial, which may be withdrawn into the syringe and subsequently injected into a patient.

Vials for injectable substances are available in a variety of sizes. Certain vials are sized such that the quantity of injectable fluid is suitable for a single injection only. These vials are often referred to as single-use vials. In recognition of the fact that it is difficult or impossible to successfully withdraw the entire quantity of injectable fluid from a vial, single use vials cause substantial vaccine or injectable fluid waste. Therefore, there is a trend in health care to provide vaccines and other injectable substances in multi-dose vials to minimize waste. Multi-dose vials can substantially reduce the cost of an inoculation campaign. For example, the World Health Organization reported in April, 2012 that the price of a hepatitis B vaccine was approximately $0.2 per dose for a 10 dose vial compared to approximately $0.4 per dose when the vaccine was provided in one-dose vials.

One challenge presented by the use of multi-dose vials is the need to maintain a sterile seal over the contents of the vial in between the withdrawal of subsequent doses. Dose-to-dose sterility may be accomplished with a conventional needle-based injection system without substantially modifying a conventional rubber septum vial configuration. Since a hypodermic needle has a sharp point and a relatively thin cross section, and because the vial septum has substantial thickness, the septum tends to self-seal as a hypodermic needle is withdrawn. Therefore, multiple needle insertions into a multi-use vial may be accomplished to withdraw multiple doses, provided care is taken not to compromise the structural integrity of the vial septum.

Although needle-based injection systems are relatively easy to fill from standard vials, needles present certain problems when an injection is made into a patient. Therefore, various types of apparatus have been developed which provide for needle-free injections. The advantages of needle-free injection devices have been recognized for some time. Some of the advantages of needle-free devices and methods include the absence of a needle which can intimidate a patient and also present a hazard to healthcare workers. In addition, needle-free injection may decrease the risk of cross-contamination between patients.

Since a needle-free injection syringe does not employ a needle which could be used to pierce a vial septum, special challenges are presented when filling a needle-free syringe from a conventional vial of injectable substance. The challenges presented when filling a needle-free syringe from a conventional vial/septum system are particularly acute when utilizing a multi-dose vial as the vaccine source.

The embodiments disclosed herein are directed toward overcoming one or more of the problems discussed above.

SUMMARY OF THE EMBODIMENTS

The embodiments disclosed herein relate generally to a vial adapter for a needle-free injection syringe and to methods of filling a needle-free syringe from a vial of injectable fluid. One embodiment includes a vial adapter comprising a housing and a compliant valve. The housing includes a vial opening and a needle-free syringe opening opposite the vial opening. A central divider is located between the vial opening and the needle-free syringe opening. The housing also includes a center post extending from the central divider toward the needle-free syringe opening and a filling needle extending from the central divider toward the vial opening. Together, the filling needle and center post define an inner lumen through the central divider which provides for fluid communication between the vial opening and the needle-free syringe opening.

The compliant valve element is operatively associated with the needle-free syringe opening of the housing. The compliant valve includes a divider sealing surface forming a fluid tight seal with the central divider and an inner passageway defined by a wall of the compliant valve. When the compliant valve is positioned within the needle-free syringe opening of the housing, a syringe sealing surface provides for a fluid tight seal with a needle-free syringe to be placed into contact with the compliant valve. The compliant valve also includes an opening in the syringe sealing surface which is biased closed when no needle-free syringe is engaged with the vial adapter and which is actively forced open when a needle-free syringe is fully engaged with the opening.

In certain embodiments, the center post includes an active valve surface and the inner passageway of the compliant valve defines a valve annulus which is caused to slide over the active valve surface when a needle-free syringe is engaged with the vial adapter. Interaction between the active valve surface and the valve annulus actively forces the compliant valve opening into an open configuration. In certain embodiments, no portion of the center post extends through the opening when the opening is forced into an open configuration.

As noted above, the compliant valve includes a syringe sealing surface configured to mate with a needle-free syringe. The syringe sealing surface may include a raised or otherwise structured sealing ring providing for sealing engagement with a corresponding recessed or otherwise structured ring surface of a needle-free syringe. The wall of the compliant valve may be formed to define a plurality of accordion folds. In this manner, an inner extension one or more of the accordion folds may contact the center post when the compliant valve is compressed, thereby preventing the compliant valve from being tilted away from the axis of the center post. The accordion folds in conjunction with the elastomeric material from which the compliant valve is fabricated also assure that the compliant valve has significant "memory" or rebound ability so that the compliant valve will readily return to a relaxed and closed configuration as compressive forces are removed from the compliant valve.

The housing may include a syringe mount associated with the needle-free syringe opening. The syringe mount is configured to engage with a needle-free syringe and secure it in place for filling operations. For example, a syringe mount may be implemented as a bayonet mount which causes the needle-free syringe to compress the compliant valve toward the divider sealing surface as a needle-free syringe is engaged with the syringe mount.

The vial adapter housing may also include a vial mount, for example, multiple fingers associated with the vial opening. In this embodiment, the fingers define clip surfaces configured to snap fit over a vial flange.

Alternative embodiments include methods of filling a needle-free syringe using a vial adapter as described above. According to the disclosed methods, a vial is attached to one end of the vial adapter and a needle-free syringe is attached to the adapter at the opposite end. As the adapter is attached to the vial, the filling needle associated with the adapter housing pierces the vial septum. As a needle-free syringe is attached to the adapter, the normally-closed opening of the compliant valve is forced open. At this point in time, injectable fluid may be drawn from the vial, through the vial adapter and into the needle-free syringe.

As the needle-free syringe is removed from the vial adapter, the opening of the compliant valve will close, thereby sealing the content of the vial from contamination, oxidation or spillage. This is useful with multi-dose vials where the disclosed methods may further include attaching a second, third or subsequent needle-free syringe to the needle-free syringe opening and drawing injectable fluid from the multi-dose vial into the subsequent needle-free syringe.

Another embodiment comprises a system including some or all of the various elements noted above, for example; a vial containing injectable fluid, a needle-free syringe and a vial adapter as described herein.

DETAILED DESCRIPTION

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

Figure 1:
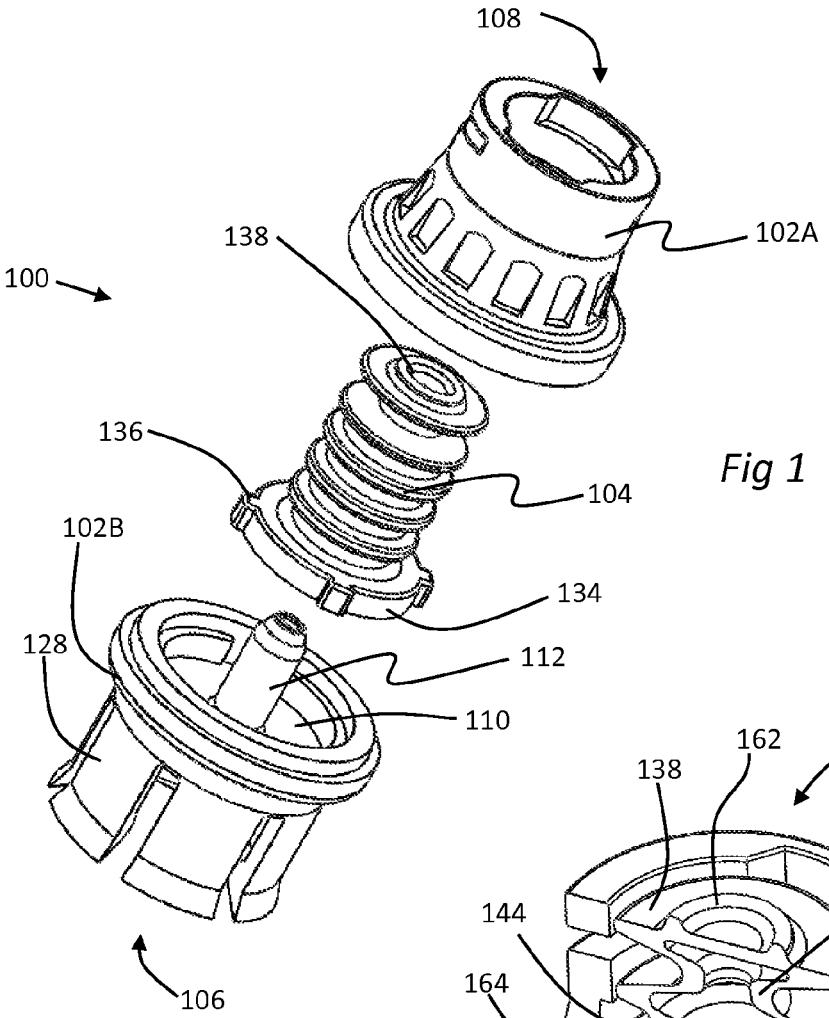
FIG. 1 is an exploded perspective view of a vial adapter.

FIG. 1 is an exploded perspective view of a vial adapter 100 as disclosed herein. The vial adapter 100 includes a housing 102 and a compliant valve 104. In the embodiment of FIG. 1, the housing 102 comprises a syringe-side housing element 102A and a vial-side housing element 102B which are permanently bonded to each other in a manufacturing step. Alternative housing configurations which are fabricated from one or more than two components are within the scope of the present disclosure.

Figure 2:
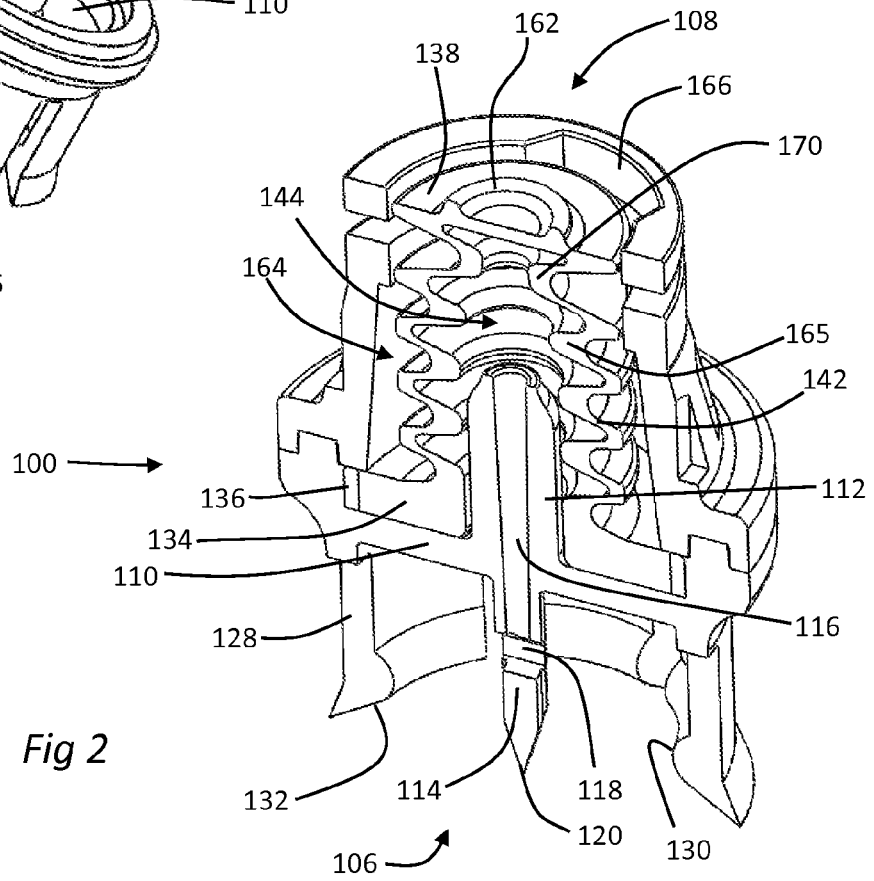
FIG. 2 is a perspective cross-section view of a vial adapter.
Figure 3:
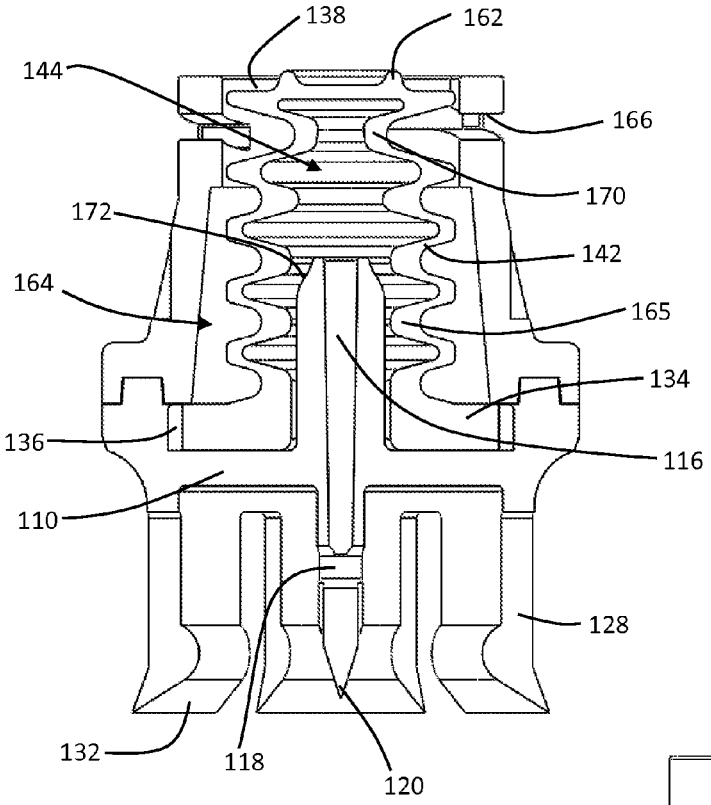
FIG. 3 is a side elevation cross-section view of a vial adapter.
Figure 4:
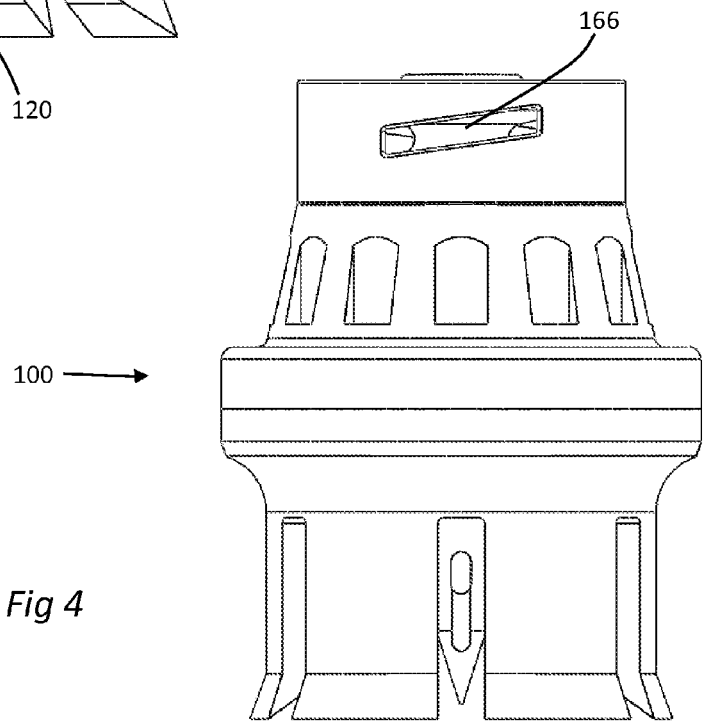
FIG. 4 is a side elevation view of a vial adapter.

FIG. 2 is a perspective cross section view of the vial adapter 100 in a fully assembled configuration. FIG. 3 is a side elevation cross-section view of the vial adapter 100 and FIG. 4 is a side elevation view of the vial adapter 100. FIGS. 1-4 illustrate various elements of the vial adapter 100 including structures which provide for the attachment of one end of the vial adapter to a conventional medicine vial and for attachment of the other end of the vial adapter to a needle-free syringe for filling operations. In particular, the housing 102 of the vial adapter 100 defines a vial opening 106 and a needle-free syringe opening 108 opening opposite the vial opening. These openings may include apparatus providing for the attachment of the vial adapter 100 to a vial and needle-free syringe respectively in order to accomplish filling operations efficiently and without compromising the integrity of the injectable fluid.

Figure 5:
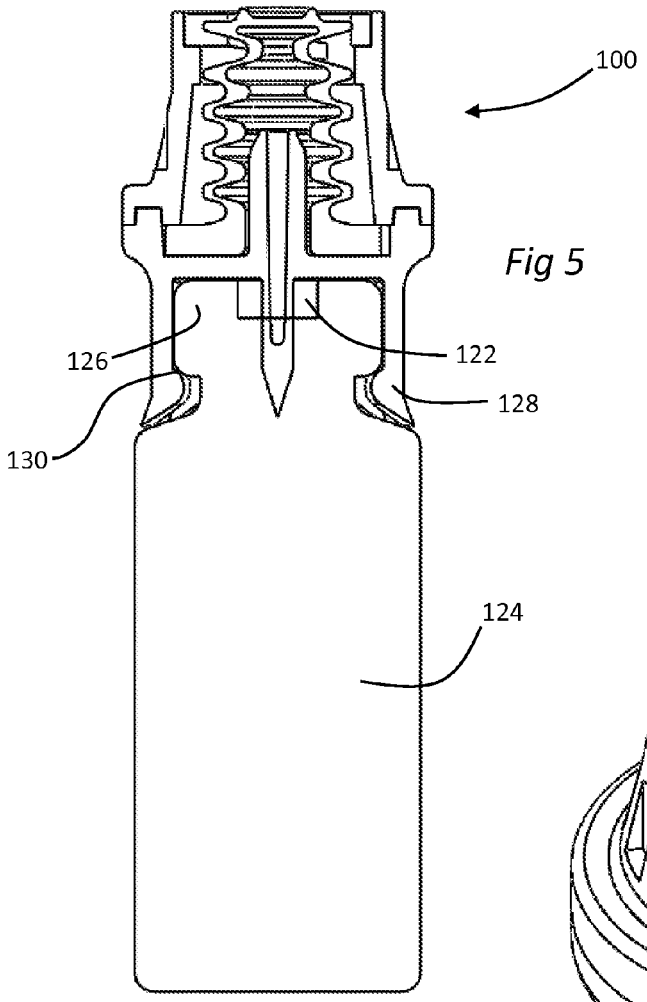
FIG. 5 is a side elevation cross-section view of a vial adapter attached to a vial.

The housing 102 may be formed from a substantially rigid plastic material by injection molding or other known plastic processing techniques. The housing 102 includes a central divider 110 which separates the vial opening 106 from the needle-free syringe opening 108. A center post 112 extends from the central divider 110 toward the needle-free syringe opening 108. On the opposite side of the central divider 110, a filling needle 114 extends toward the vial opening. As is best seen on FIG. 3, the center post 112 and filling needle 114 together define an inner lumen 116 through the central divider 110. The inner lumen 116 opens into the needle-free syringe opening 108 at the top of the center post 112. Similarly, the inner lumen 116, through a lateral filling needle opening 118, opens into the vial opening 106. The filling needle 114 also includes a sharp point 120. Thus, as shown in FIG. 5, when the vial adapter 100 is engaged with a vial 124, the filling needle point 120 will pierce the septum 122 of the vial 124. When the septum is pierced by the filling needle 114, the elastomeric septum material forms a tight seal around the exterior surface of the filling needle 114 and the lateral filling needle opening 118 is placed into fluid communication with the contents of the vial 124.

As noted above, the inner lumen 116 extends from the lateral filling needle opening 118 through the central divider 110 and center post 112. Therefore, placement of the vial adapter 100 onto a vial 124 as shown in FIG. 5 places the center post 112 and, as described in detail below, the inner passageway of the compliant valve 104 into fluid communication with the injectable fluid within the vial 124.

A standard medicine vial of any size will typically be provided with a flange top 126 which receives the septum 122. In order to securely engage with a vial, the vial adapter 100 may be provided with multiple fingers 128 which comprise clip surfaces 130 configured to mate with a vial flange top 126. Although the housing 102 of the vial adapter 100 is typically fabricated from a substantially rigid plastic material, the inclusion of separate fingers 128 at the vial opening 106 allows the fingers 128 to flex outward when the vial adapter 100 is pressed into a snap-fit engagement with the vial flange top 126. Ramp surfaces 132 associated with the fingers 128 facilitate the outward flexing of the fingers as the adapter 100 is engaged with a vial flange top 126.

As noted above, a vial adapter 100 also includes a compliant valve 104 operatively associated with the needle-free syringe opening 108 of the housing 102. The compliant valve 104 includes a divider sealing surface 134 which forms a fluid tight seal with the central divider 110 when the valve adapter 100 is assembled. As more particularly shown in FIGS. 1-3, the compliant valve 104 may also include one or multiple tabs 136 which may be secured between the housing elements 102A and 102B when the valve is assembled or otherwise attached to the housing.

Figure 6:
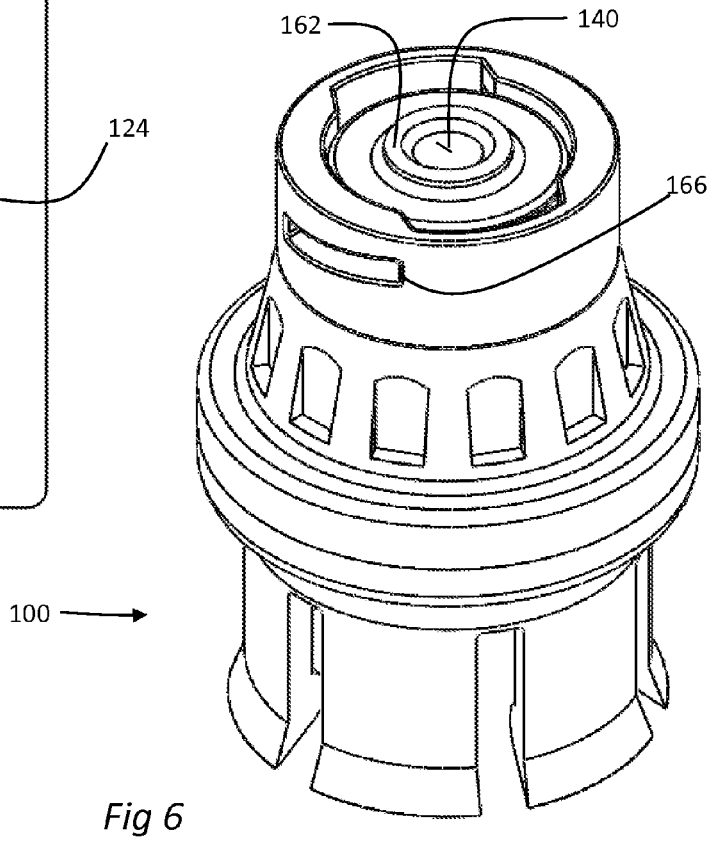
FIG. 6 is a perspective view of a vial adapter.

The compliant valve 104 also includes a syringe sealing surface 138 opposite the divider sealing surface 134. The syringe sealing surface 138 provides for a fluid-tight seal with a needle-free syringe when a syringe is placed into contact with the vial adapter as described in detail below. As best viewed in FIG. 6, the syringe sealing surface 138 is pierced with a small opening 140. The opening 140 provides for a fluid passageway through the syringe sealing surface 138 at certain specific points in time during syringe filling operations. The opening 140 may be a small linear slit, for example a slit cut into the syringe sealing surface 138 during production. Alternatively the opening may be a tiny hole of other shape. The opening 140 must not allow fluid passage when the compliant valve 104 is in a relaxed state. Thus, the opening 140 must be biased into a closed and a substantially fluid-tight configuration by the elastomeric material from which the compliant valve is constructed, when no external forces are placed upon the compliant valve. A very thin slit provided in the syringe sealing surface 138 will behave in this fashion since no elastomeric material is removed from the opening 140 provided the slit is made with an exceptionally sharp instrument. Therefore, when no needle-free syringe is engaged with the compliant valve 104, the opening 140 is biased into a closed and fluid-tight, configuration.

The divider sealing surface 134 of the compliant valve 104 defines a substantially circular central hole which surrounds the base of the center post 112. In between the divider sealing surface 134 and the syringe sealing surface 138, the wall 142 of the compliant valve 104 defines an inner passageway 144. As noted above, an inner lumen 116 passes through the center post 112 and filling needle 114. Thus, when the vial adapter 100 is placed into engagement with a vial 124 as shown in FIG. 5, the inner passageway 144 of the compliant valve 104 is placed into fluid communication with any injectable fluid contained within the vial 124. It is important to note however, that the normally-closed configuration of the opening 140 seals the contents of the vial from contamination, oxidation or leakage when the compliant valve 104 is in a relaxed state.

The compliant valve 104 may be made of any material which is impervious to commonly injected fluids and which has sufficiently elastic qualities to form the necessary seals with the central divider 110 and a needle-free syringe and to sufficiently bias the opening 140 closed when the valve 104 is not being actuated. Representative materials suitable for the fabrication of a compliant valve 104 include, but are not limited to, silicone-based polymers and various rubber compositions.

Figure 7:
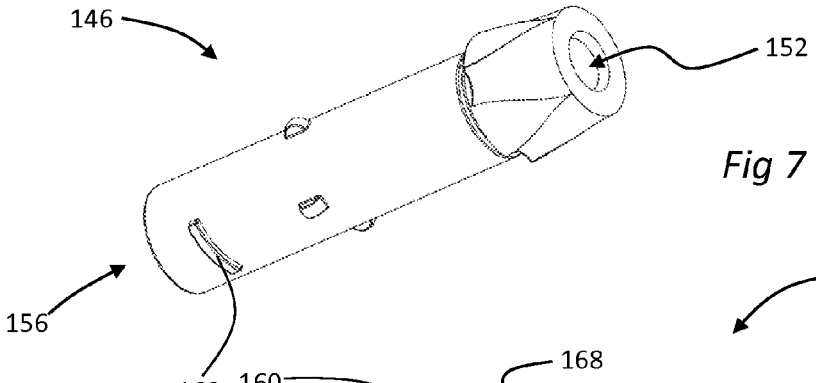
FIG. 7 is a perspective view of a needle-free syringe.
Figure 8:
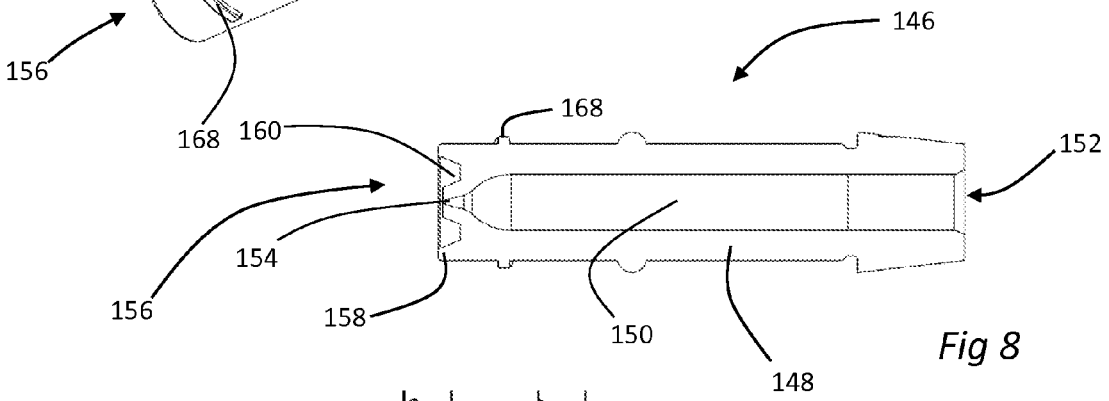
FIG. 8 is a side elevation cross-section view of a needle-free syringe.

The syringe sealing surface 138 of the compliant valve 104 provides for a substantially fluid tight seal with a needle-free syringe during filling operations. A representative needle-free syringe 146 is shown in FIGS. 7 and 8. It is important to note that the disclosed embodiments of vial adapter 100 are not limited to use with any particular configuration of needle—the syringe. Typically, however, a vial adapter embodiment will be specifically configured to work with needle-free syringe is having structural attributes providing for effective and repeatable connection to the vial adapter.

The needle-free syringe 146 includes among other elements a syringe wall 148 which defines a dosage space 150. In use, a syringe plunger (not shown on FIG. 7 or 8) is received in the open plunger end 152 opposite an injection nozzle 154 at a nozzle end 156 of the needle-free syringe.

As best viewed on FIG. 8, the nozzle end 156 of a needle-free syringe may include a raised ring 158 or other structure which in use makes contact with the patient's skin. Between the raised ring 158 and the nozzle 154 the nozzle end of the syringe defines a recessed ring surface 160. When a needle-free syringe 146 is attached to a vial adapter 100, the recessed ring 160 and the raised ring surface 158 may engage with a raised sealing ring 162 provided on the syringe sealing surface 138. Engagement between the raised sealing ring 162 and corresponding structures formed at the nozzle end of a needle-free syringe enhances the fluid-tight seal between the compliant valve 104 and the needle-free syringe 146 during filling operations. In addition, engagement between the described structures facilitates the proper centering of the needle-free syringe 146 on the compliant valve during filling operations and along with interaction between the compliant valve 104 And center post 112, as described below, prevents the compliant valve from tilting away from a central axis defined by the center post 112 during filling operations.

As best shown in FIGS. 2-3, the compliant valve 104 may be provided with a plurality of accordion folds 164 defined by the compliant valve wall 142. The accordion folds 164 include inner extensions 165 which contact, or nearly contact, an outer surface of the center post 112 when the compliant valve 104 is compressed during filling operations. The accordion folds 164 therefore facilitate linear compression of the compliant valve and interaction between the inner extensions 165 and the center post 112 also serves to prevent the compliant valve from being tilted away from the axis of the center post 112 when compressed. The accordion folds 164, in conjunction with the elastomeric material chosen for the compliant valve 104, also impart a significant structural "memory" to the compliant valve 104. Thus, as compressive forces are removed from the compliant valve the valve will readily return to the relaxed and closed uncompressed state.

Figure 9:
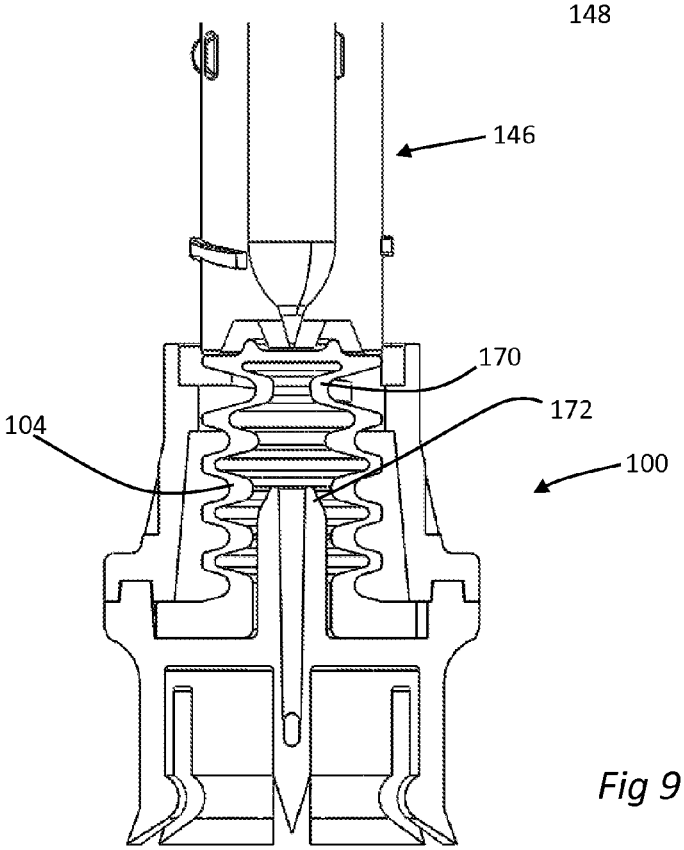
FIG. 9 is a side elevation cross-section view of a needle-free syringe and vial adapter immediately prior to connecting the needle-free syringe to the vial adapter.
Figure 10:
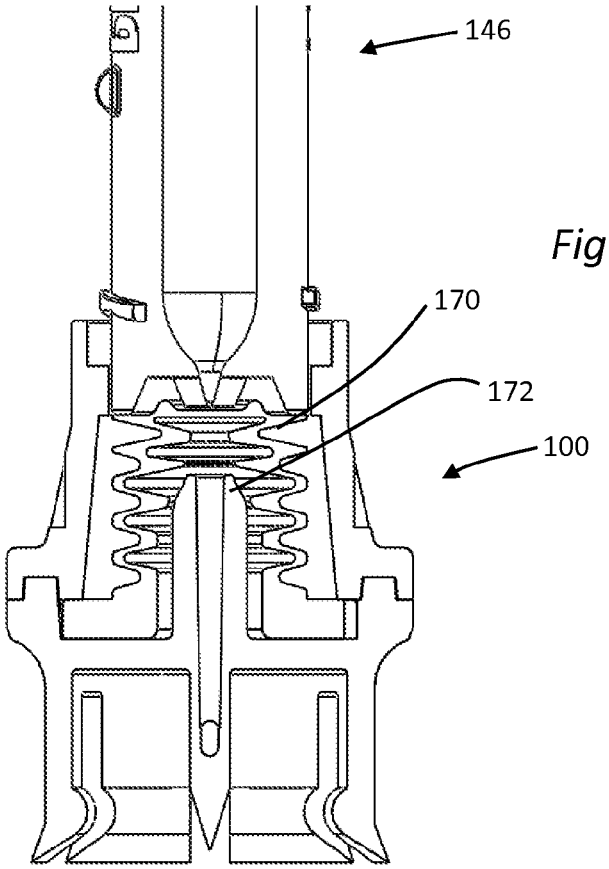
FIG. 10 is a side elevation cross-section view of a needle-free syringe and vial adapter during the process of connecting the needle-free syringe to the vial adapter.
Figure 11:
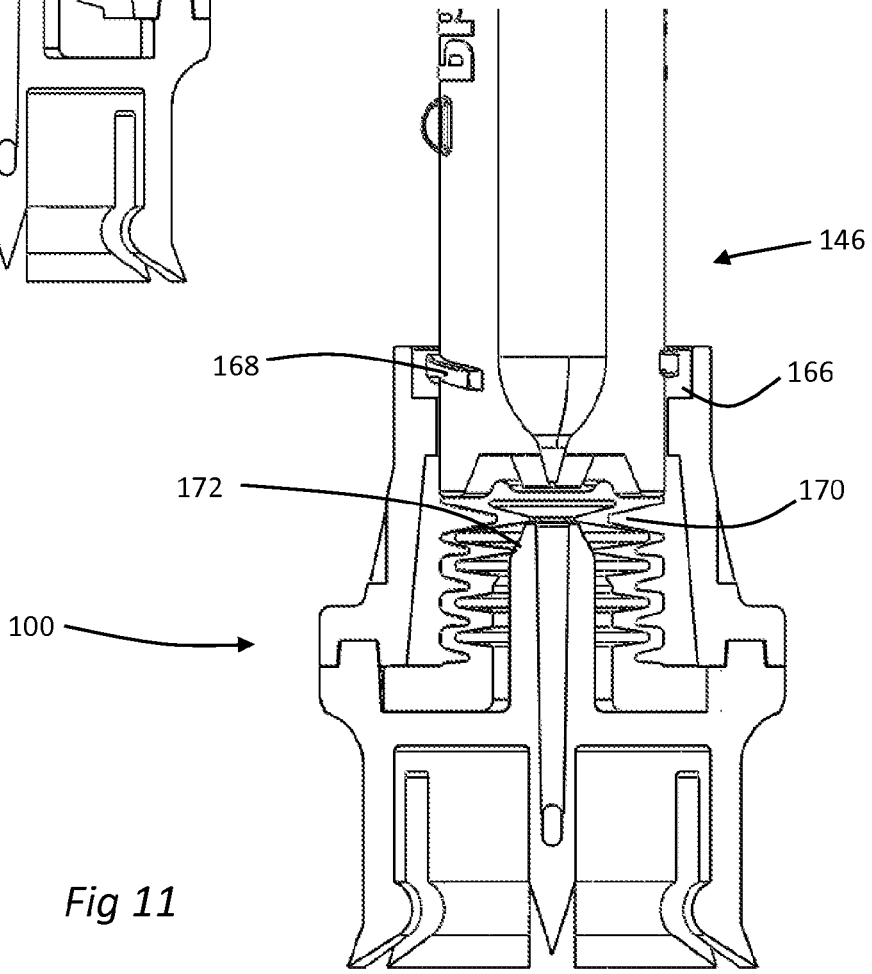
FIG. 11 is a side elevation cross-section view of a needle-free syringe and vial adapter after connecting the needle-free syringe to the vial adapter.

As noted above, the opening 140 in the syringe sealing surface 138 of the compliant valve 104 is closed when the compliant valve is in a relaxed state. As shown in FIGS. 9-11 the action of mounting or attaching a needle-free syringe 146 to the vial adapter 100 can actively cause the opening 140 to be forced open, thereby placing the dosage space 150 into fluid communication through the opening and syringe nozzle with the content of a vial for filling operations. In particular, the attachment of a needle-free syringe 146 to a vial adapter 100 begins when an operator approximately centers the nozzle end 156 of the syringe over the syringe sealing surface 138 of the compliant valve 104 (FIG. 9). Then, the operator may press the needle-free syringe into the needle-free syringe opening 108, toward the vial end of the adapter. As shown in FIG. 10, this action compresses the compliant valve 104. The compliant valve does not unduly tilt or buckle during compression because of cooperation between the accordion folds 162 and the center post 112, plus cooperation between any raised sealing ring 162 and corresponding structures at the nozzle end of the needle-free syringe.

When the needle-free syringe 146 is fully inserted into the syringe opening 108, as shown in FIG. 11, the compliant valve 104 is significantly compressed. In this configuration, a syringe mount structure associated with the vial adapter 100 and/or the needle-free syringe 146 may be provided to secure the syringe for filling operations and to cause a predetermined amount of final compression to the compliant valve before filling operations commence. For example, the vial adapter housing may define one or more bayonet-receiving slots 166 which correspond to one or more bayonet mount structures 168 on the outside of a needle-free syringe. In use, after the compliant valve has been partially compressed, the bayonet structures 166 and 168 may be engaged with each other and the syringe may be slightly rotated, thereby drawing the syringe into the final filling position and locking it into place (FIG. 11). The action of engaging the bayonet structure's 166 and 168 also places a pre-specified amount of final compression on the compliant valve 104.

Before filling operations may commence, the opening 140 must be actively forced open. The opening may be partially forced open by tensile forces placed upon the syringe sealing surface 138 as the compliant valve 104 is compressed. In the illustrated embodiments however, the center post 112 comprises an active valve surface which cooperates with a valve annulus 170 formed in compliant valve 104 to force the valve opening 140 into an open position as the fully compressed configuration of FIG. 11 is reached. In particular, the center post 112 includes an active ramp surface 172 which causes the valve annulus 170 portion of the compliant valve 104 to be expanded or stretched as the valve annulus 170 slides over the active ramp surface 172 during the final stages of valve compression. As may be noted from FIGS. 9-11, the valve annulus 170 is positioned immediately below the syringe sealing surface 138. Thus, when the valve annulus 170 is expanded by sliding the annulus over the active ramp surface 172, outward tension is placed upon the syringe sealing surface forcing the opening 140 into an open configuration. It is important to note that at no time does any portion of the center post 112 or any other portion of the housing extend through the opening 140. Therefore, the seal between the syringe sealing surface 138 and the needle-free syringe will not be compromised.

Syringe filling operations may commence when a needle-free syringe and a vial of injectable liquid are both attached to the vial adapter at the proper openings. The needle-free syringe may be filled in the conventional manner by withdrawing a plunger previously installed in the dosage space 150 of the needle-free syringe. After the desired amount of injectable fluid has been drawn into the needle-free syringe, the syringe may be removed from the adapter by rotating the bayonet mounting structures 166-168 out of contact or otherwise disengaging the needle-free syringe from the vial adapter and withdrawing the syringe. As the needle-free syringe is withdrawn, the compliant valve 104 will extend toward the relaxed position and the opening 140 will close as described above. A comparison of FIGS. 9 and 10 with FIG. 11 reveals that the valve annulus 170 disengages from the active ramp surface 172 of the center post 112 well in advance of the point in time when the needle-free syringe becomes disengaged from the syringe sealing surface 138. Therefore, the opening 140 is closed by contraction of the elastomeric compliant valve material before the syringe is fully withdrawn. In this manner the contents of vial are protected from contamination, oxidation or spillage. If the vial adapter 100 has been attached to a multi-dose vial, subsequent filling operations may be performed with a series of needle-free syringes. If desired, a vial adapter 100 may be left attached to a multi-dose vial for a reasonable period of time with the sterility of the vial contents preserved by the seal provided by the compliant valve and normally-closed opening 140

Alternative embodiments include methods of filling a needle-free syringe from a vial as described in detail above. Other embodiments include a system comprising at least a vial and adapter as described above. In certain embodiments the system will include one or more needle-free syringes configured for attachment to the vial adapter for filling operations. A system embodiment may also include a needle-free injection device configured to receive a needle-free syringe filled with an injectable substance as described above.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

While the embodiments described herein have been particularly shown and described with reference to a number of possible variations, it would be understood by those skilled in the art that changes in the form and details may be made to various components or elements without departing from the spirit and scope of the embodiments and that the various embodiments disclosed herein are not intended to act as limitations on the scope of the claims. All references cited herein are incorporated in their entirety by reference.

What is claimed is:

1. A vial adapter comprising:

a housing comprising;

a vial opening;

a needle-free syringe opening opposite the vial opening;

a central divider between the vial opening and the needle-free syringe opening;

a center post extending from the central divider toward the needle-free syringe opening, the center post comprising an active valve surface; and a filling needle extending from the central divider toward the vial opening, wherein the filling needle and center post define an inner lumen through the central divider, which provides for fluid communication between the vial opening and the needle-free syringe opening; and a compliant valve operatively associated with the needle-free syringe opening of the housing, the compliant valve comprising;

a divider sealing surface forming a fluid tight seal with the central divider;

an inner passageway defined by a wall of the compliant valve, wherein said inner passageway of the compliant valve defines a valve annulus;

a syringe sealing surface providing for a fluid tight seal with a needle-free syringe placed into contact with the compliant valve; and an opening in the syringe sealing surface which is biased closed when no needle-free syringe is engaged with the vial adapter and which is opened by causing the valve annulus to slide over the active valve surface, thereby actively forcing the opening into an open configuration when a needle-free syringe is engaged with the opening.

2. The vial adapter of claim 1 wherein no portion of the center post extends through the opening when the opening is forced into an open configuration.

3. The vial adapter of claim 1 wherein the housing further comprises a syringe mount associated with the needle-free syringe opening configured to engage with a needle-free syringe.

4. The vial adapter of claim 3 wherein the syringe mount comprises a bayonet mount which causes the needle-free syringe to compress the compliant valve toward the divider sealing surface as a needle-free syringe is engaged with the syringe mount.

5. The vial adapter of claim 1 wherein the housing further comprises multiple fingers associated with the vial opening which comprise clip surfaces configured to snap fit over a vial flange.

6. The vial adapter of claim 1 wherein the syringe sealing surface comprises a raised sealing ring providing for sealing engagement with a corresponding recessed ring surface of a needle-free syringe.

7. The vial adapter of claim 1 wherein the wall of the compliant valve comprises a plurality of accordion folds.

8. The vial adapter of claim 1 wherein an inner extension one or more of the accordion folds contact the center post when the compliant valve is compressed preventing the compliant valve from being tilted away from the axis of the center post.

9. A method of filling a needle-free syringe comprising:
providing a vial adapter comprising:
a housing comprising;
a vial opening;
a needle-free syringe opening opposite the vial opening;
a central divider between the vial opening and the needle-free syringe opening;
a center post extending from the central divider toward the needle-free syringe opening, the center post comprising an active valve surface;
a filling needle extending from the central divider toward the vial opening, wherein the filling needle and center post define an inner lumen which provides for fluid communication through the central divider between the vial opening and the needle-free syringe opening; and
a compliant valve operatively associated with the needle-free syringe opening of the housing, the compliant valve comprising;
a divider sealing surface forming a fluid tight seal with the central divider;
an inner passageway defined by a wall of the compliant valve, wherein said inner passageway of the compliant valve defines a valve annulus;
a syringe sealing surface providing for a fluid tight seal with a needle-free syringe when placed into contact with the compliant valve;
an opening in the syringe sealing surface which is biased closed when no needle-free syringe is engaged with the vial adapter and which opening is opened by causing the valve annulus to slide over the active valve surface, thereby actively forcing the opening into an open configuration when a needle-free syringe is engaged with the opening;
attaching a vial of an injectable fluid to the vial opening thereby causing the filling needle to pierce a vial septum;
attaching a needle-free syringe to the needle-free syringe opening, thereby causing the opening in the syringe sealing surface to be opened; and
drawing injectable fluid from the vial, through the vial adapter and into the needle-free syringe.

10. The method of claim 9 further comprising removing the needle-free syringe thereby allowing the opening in the syringe sealing surface to be biased closed.

11. The method of claim 10 wherein the vial is a multi-dose vial, the method further comprising attaching a second needle-free syringe to the needle-free syringe opening, and drawing injectable fluid from the multi-dose vial into the second needle-free syringe.

12. The method of claim 9 wherein no portion of the center post is caused to extend through the opening when the opening is forced into an open configuration.

13. The method of claim 9 further comprising providing a syringe mount which causes the needle-free syringe to compress the compliant valve toward the divider sealing surface as a needle-free syringe is engaged with the syringe mount.

14. The method of claim 9 further comprising:
providing a housing with multiple fingers associated with the vial opening, said fingers comprising clip surfaces configured to snap fit over a vial flange; and
attaching the vial to the vial adapter by snap fitting the clip surfaces over a vial flange.

15. The method of claim 9 further comprising:
providing a vial adapter having a syringe sealing surface comprising a raised sealing ring;
providing a needle-fee syringe comprising a corresponding recessed ring surface; and
causing a seal to form between the raised sealing ring and the recessed ring surface as the needle-free syringe is attached to the needle-free syringe opening.

16. The method of claim 9 further comprising:
providing a vial adapter including a plurality of accordion folds defined by the wall of the compliant valve; and
preventing the compliant valve from being tilted away from the axis of the center post by contacting an inner extension one or more of the accordion folds with the center post as the compliant valve is compressed.

17. A system comprising:
a vial containing injectable fluid;
a needle-free syringe; and
a vial adapter comprising:
a housing comprising;
a vial opening providing for engagement with the vial containing injectable fluid;
a needle-free syringe opening opposite the vial opening;
a central divider between the vial opening and the needle-free syringe opening;
a center post extending from the central divider toward the needle-free syringe opening, the center post comprising an active valve surface; and
a filling needle extending from the central divider toward the vial opening, wherein the filling needle and center post define an inner lumen through the central divider, which provides for fluid communication between the vial opening and the needle-free syringe opening; and
a compliant valve operatively associated with the needle-free syringe opening of the housing, the compliant valve comprising;
a divider sealing surface forming a fluid tight seal with the central divider;
an inner passageway defined by a wall of the compliant valve, wherein said inner passageway of the compliant valve defines a valve annulus;
a syringe sealing surface providing for a fluid tight seal with the needle-free syringe when placed into contact with the compliant valve; and
an opening in the syringe sealing surface which is biased closed when the needle-free syringe is not engaged with the vial adapter and which is actively opened by causing the valve annulus to slide over the active valve surface, thereby actively forcing the opening into an open configuration when the needle-free syringe is engaged with the opening.

* * * * *